United States Patent [19]

Hamana et al.

[11] 4,000,239

[45] Dec. 28, 1976

[54] PROCESS FOR SPINNING NAPHTHALATE POLYESTER FIBERS

[75] Inventors: Isao Hamana; Yoshio Fuziwara; Shiro Kumakawa, all of Iwakuni, Japan

[73] Assignee: Teijin Limited, Osaka, Japan

[22] Filed: Nov. 30, 1973

[21] Appl. No.: 420,595

Related U.S. Application Data

[62] Division of Ser. No. 313,693, Dec. 11, 1972, abandoned.

[30] Foreign Application Priority Data

Dec. 13, 1971 Japan ..... 46-100854

[52] U.S. Cl. ..... 264/176 F; 264/210 F

[51] Int. Cl.[2] ..... D01D 5/12

[58] Field of Search ..... 260/75 T, 75 R; 264/176 F, 210 F, 290 T

[56] References Cited

UNITED STATES PATENTS

| | | | |
|---|---|---|---|
| 2,604,667 | 7/1952 | Hebeler | 264/168 |
| 3,361,859 | 1/1968 | Cenzato | 264/210 F |
| 3,452,132 | 6/1969 | Petzl | 264/210 F |
| 3,486,318 | 12/1969 | Cannon et al. | 264/210 F |
| 3,549,597 | 12/1970 | Kiston et al. | 264/290 T |
| 3,616,832 | 11/1971 | Shima | 264/210 F |
| 3,707,593 | 12/1972 | Fukada et al. | 264/176 F |
| 3,875,119 | 4/1975 | Aoki et al. | 264/289 |

FOREIGN PATENTS OR APPLICATIONS

| | | | |
|---|---|---|---|
| 43-11,824 | 5/1968 | Japan | 264/210 F |
| 45-1,932 | 1/1970 | Japan | 264/210 F |

*Primary Examiner*—Jay H. Woo
*Attorney, Agent, or Firm*—Sherman & Shalloway

[57] ABSTRACT

A filament, fiber or yarn consisting of a naphthalate polyester containing at least 85 mol % of ethylene-2,6-naphthalate units and having an intrinsic viscosity of 0.45 to 1.0, said filament, fiber or yarn having a diffrection intensity ratio (R) between a bragg refection angle $2\theta = 187.7°$ and $2\theta = 15.6°$, as determined by the X-ray diffraction method, being in the range of more than 1.73 and up to 5.00.

Electrically insulating material can be produced by heat-treating a fabric consisting mainly of the above naphthalate polyester fibers and with a sleeve consisting mainly of the above naphthalate polyester fibers.

2 Claims, 3 Drawing Figures

FIG. 1
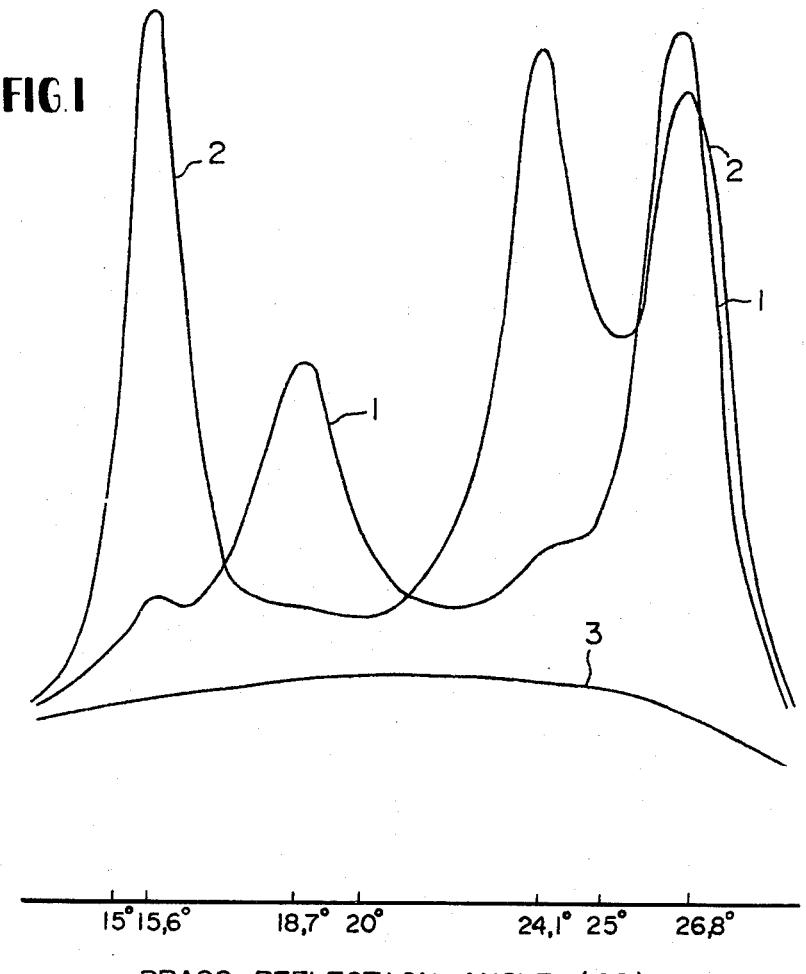
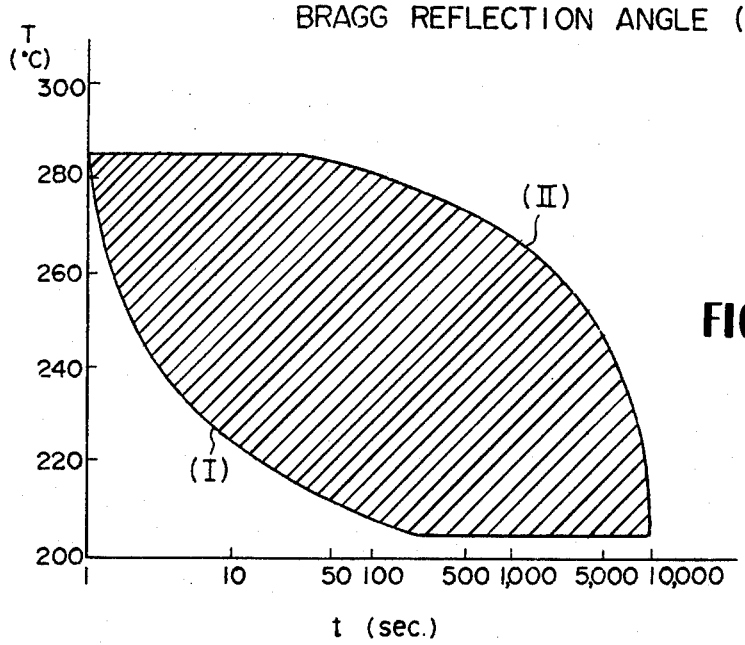
FIG. 3

PROCESS FOR SPINNING NAPHTHALATE POLYESTER FIBERS

This is a division of application Ser. No. 313,693, filed Dec. 11, 1972, now abandoned.

This invention relates to novel naphthalate polyester fibers, a process for the preparation thereof, and their end uses. More specifically, the invention relates to naphthalate polyester fibers having a novel crystalline structure and being especially suited for electrical insulating materials, a process for producing said fibers on an industrial scale, and their end uses.

Fibers made from the naphthalate polyesters obtained by the reaction of naphthalene-2,6-dicarboxylic acid with ethylene glycol have recently been noted as industrial materials such as rubber-reinforcing materials because of their superiority in mechanical and thermal properties to fibers of a polyethylene terephthalate which have been widely used previously (U.S. Pat. No. 3,616,832).

It has however been thought that the conventional naphthalate polyester fibers are unsuitable for use in the field where knitted, woven or non-woven fabrics made from these fibers are used at high temperatures, especially in the field of electric insulating materials. This is mainly because these naphthalate polyesters have low elongation and suffer from a reduction in tenacity at high temperatures.

We made extensive research and development work relating to naphthalate polyester fibers having greater toughness and dyeability, higher melting point and less reduction in tenacity at high temperatures than the conventional napthalate polyester fibers and having suitable properties as electric insulating materials which on the other hand retain excellent properties of the conventional naphthalate polyester fibers, such as high tenacity, high Young's modulus, and good dimensional stability against heat. As a result, it was found that by imparting a special crystalline structure different from those of the conventional naphthalate polyester fibers, the toughness, tenacity at high temperature, dyeability and resistance to heat of the naphthalate polyester fibers can be improved.

One object of this invention is to provide novel naphthalate polyester fibers having a new crystalline structure, which possess greater toughness and dyeability, higher melting point and less reduction in tenacity at high temperatures than the conventional naphthalate polyester fibers.

Another object of this invention is to provide a process for producing the novel naphthalate polyester fibers advantageously.

Still another object of this invention is to provide a cloth or sleeve suitable for electrically insulating materials consisting mainly of the novel naphthalate polyester fibers.

Other objects will become apparent from the following description of this invention.

According to the present invention, there are provided novel naphthalate polyester fibers, said fibers consisting of a naphthalate polyester containing at least 85 mol % of ethylene-2,6-naphthlate units and having an intrinsic viscosity of from 0.45 to 1.0, said fibers having a diffraction intensity ratio (R) between a Bragg reflection angle $2\theta = 18.7°$ and $2\theta = 15.6°$ as determined by the X-ray diffraction method, being in the range of more than 1.73 and up to 5.00.

The polymer which constitutes the fibers of this invention is a polyethylene-2,6-naphthalate or a copolymerized polyethylene-2,6-naphthalate containing not more than 15 mol %, preferably not more than 5 mol %, of a third component.

Generally, a polyethylene-2,6-naphthalate is prepared by reacting naphthalene-2,6-dicarboxylic acid or its functional derivative with ethylene glycol or its functional derivative in the presence of a catalyst under proper reaction conditions. When at least one third component is added before the completion of the polymerization, a copolymerized or blended polyester results. Suitable third components are (a) compounds having two ester-forming functional groups, for example, aliphatic dicarboxylic acids such as oxalic acid, succinic acid, adipic acid, sebacic acid or dimeric acid; alicyclic dicarboxylic acids such as cyclopropanedicarboxylic acid, cyclobutanedicarboxylic acid, or hexahydroterephthalic acid; aromatic dicarboxylic acids such as phthalic acid, terephthalic acid, isophthalic acid, naphthalene-2,7-dicarboxylic acid or diphenyldicarboxylic acid; carboxylic acids such as diphenyl ether dicarboxylic acid, diphenyl sulfone dicarboxylic acid, diphenoxydiethane dicarboxylic acid or sodium 3,5-dicarboxybenzenesulfonicate; hydroxycarboxylic acids such as glycolic acid, p-hydroxybenzoic acid or p-hydroxyethoxybenzoic acid; hydroxy compounds such as propyl glycol, trimethylene glycol, diethylene glycol, tetramethylene glycol, hexamethylene glycol, neopentylene glycol, p-xylene glycol, 1,4-cyclohexanedimethanol, bisphenol A, p,p'-diphenoxysulfone, 1,4-bis ($\beta$-hydroxyethoxy) benzene, 2,2'-bis(p-$\beta$-hydroxydiethoxyphenyl) propane, polyalkylene, glycol, or p-phenylene bis(dimethylcyclohexane) or functional derivatives thereof; or high-molecular-weight compounds derived from said carboxylic acids, hydroxycarboxylic acids, hydroxy compounds or functional derivatives thereof; (b) compounds having one ester-forming functional group, such as benzoic acid, benzoylbenzoic acid, benzyloxybenzoic acid, or methoxypolyalkylene glycol; (c) compounds having three or more ester-forming functional groups, such as glycerol, pentaerythritol or trimethylol propane; (d) functional derivatives of phosphonic acid and phosphonous acid which have two ester-forming functional groups, for example, esters derived from phosphonic acid and phosphonous acid such as methanephosphonic acid, benzylphosphonic acid, benzenephosphonic acid, p-chlorobenzenephosphonic acid, p-bromobenzenephosphonic acid, dichlorobenzenephosphonic acid, methanephosphonous acid, benzenephosphonous acid, p-chlorobenzenephosphonous acid or p-bromobenzenephosphonous, acid, phosphonyl dichlorides such as methanephosphonyl dichloride, cyclohexanephosphonyl dichloride, benzenephosphonyl dichloride, p-chlorobenzenephosphonyl dichloride, or p-bromophosphonyl dichloride, and halophosphines such as ethyldichlorophosphine, phenyldichlorophosphine, p-chlorophenyldichlorophosphine or p-bromophenyldichlorophosphine; (e) functional derivatives of phosphoric acid and phosphorous acid which have three ester-forming functional groups, for example, phosphates such as ethyl phosphate, butyl phosphate, benzyl phosphate, phenyl phosphate, p-chlorophosphate or p-bromophosphate, phosphites such as ethyl phosphite or butyl phosphite, halophosphates such as methyldichlorophosphate, phenyldichlorophosphate, 2-chlorophenyldichlorophosphate, 2-trichloromethylphenyldichlorophosphate or 4-chlorophenyldichlorophosphate, and halophosphites such as methyldichlorophosphite, benzyldichlorophosphite or p-chlorophenyldichlorophosphite (preferably, these trifunctional compounds are used together with an ester-forming monofunctional compound such as benzyl benzoate or phenyl naphthoate); and (f) functional derivatives of halogenated alcohols which have two ester-forming functional groups, such as 2,5-dichlorohydroquinone, 2,5-dibromohydroquinone, 2,3,5,6-tetrachlorohydroquinone, 2,2'-bis(4-hydroxy-3,5-dichlorophenyl) propane, 2,2'-bis(4-hydroxy-3,5-dibromophenyl) propane, 1,1'-bis(4-hydroxy-3,5-dibromophenyl) cyclohexane or 2,2'-bis(4-hydroxy-3,5-dichlorophenyl) butane. The amount of the third component must be not more than 15 mol %, preferably not more than 5 mol %. If the amount is in excess of 15 mol %, it frequently results in a considerable reduction in the thermal stability, melting point, toughness and elastic recovery of the fibers obtained, and therefore such excessive amounts should be avoided.

Needless to say, the polyester may contain a delusterant such as titanium dioxide or a stabilizer such as phosphoric acid, phosphorous acid, and esters thereof.

The naphthalate polyester used in this invention has an intrinsic viscosity [$\theta$] of from 0.45 to 1.0. The "intrinsic viscosity", as used in the present specification, is a value obtained from the viscosity of the polymer which is measured with respect to a solution of the polymer in a 6:4 mixture of phenol and o-dichlorobenzene at 35° C. When the intrinsic viscosity of the naphthalate polyester exceeds 1.0, its melt viscosity becomes exceedingly high, making the melt-spinning difficult. If the intrinsic viscosity is less than 0.45, the resulting fibers do not possess good properties intended.

The greatest feature of the fibers of the present invention resides in their novel crystalline structure. This crystalline structure is characterized by a diffraction intensity ratio (R) between a Bragg reflection angle $2\theta = 18.7°$ and $2\theta = 15.6°$ in the diffraction intensity distribution curve in the equatorial direction as determined by the X-ray diffraction method, being within the range of more than 1.73 and up to 5.00.

In the accompanying drawings,

FIG. 1 is a graphic representation illustrating the diffraction intensity distribution curves in the equatorial direction of the naphthalate polyester fibers of this invention and conventional naphthalate polyester fibers obtained by the X-ray diffraction method.

FIG. 3 is a graphic representation showing the relation between the heat-treating temperature and heat-treating time of woven fabric made from the fibers of this invention.

Figure 2:
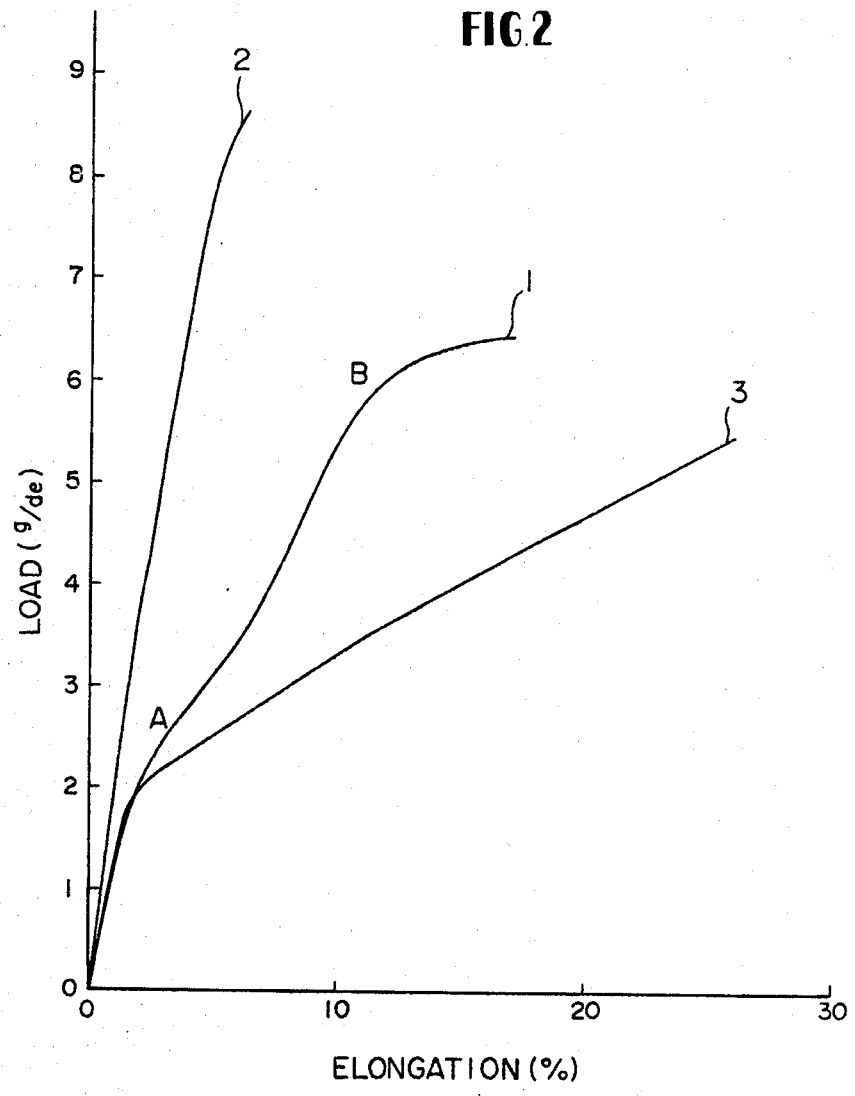
FIG. 2 shows load-elongation curves of the naphthalate polyester fibers of this invention, the conventional naphthalate polyester fibers and polyester fibers having an R value of at most 1.73.

The conditions of the measurement of the diffraction intensity curve as shown in FIG. 1 were as follows:

Device: Model D-9C (product of Rigaku Denki Kabushiki Kaisha)
Filter: Nickel filter
Power: 35 KV, 20 mA
Divergence slit: 0.15 mm $\phi$
Scattering slit: 1°
Receiving slit: 0.4 mm
Wave-length $\lambda$ No.: 1.542 A Referring to FIG. 1, curve 1 illustrates the diffraction intensity distribution curve of the fibers of this invention, and curve 2 illustrates the diffraction intensity distribution curve of the conventional naphthalate polyester fibers. Curve 3 shows the diffraction intensity distribution curve of amorphous naphthalate polyester fibers.

The diffraction intensity ratio (R) between a Bragg reflection angle $2\theta = 18.7°$ and $2\theta = 15.6°$, as used in the present specification and claims, is calculated in accordance with the following equation 1.

$$R = \frac{Ic18.7° - Ia18.7°}{Ic15.6° - Ia15.6°} \quad (1)$$

wherein $Ic18.7°$ and $Ic15.6°$ are the diffraction intensities (height of peak in the curve) at a Bragg reflection angle of $2\theta = 18.7°$ and $2\theta = 15.6°$ respectively in the X-ray diffraction intensity distribution curve of the fibers, and $Ia18.7°$ and $Ia15.6°$ are the diffraction intensities of the amophous fibers at a Bragg reflection angle of $2\theta = 18.7°$ and $2\theta = 15.6°$ in the diffraction intensity distribution curve.

As is clear from FIG. 1, the conventional naphthalate polyester fibers (curve 2) have a high peak at a Bragg reflection angle $2\theta = 15.6°$, but are substantially devoid of peak at $2\theta = 18.7°$. Therefore, these polyester fibers have a diffraction intensity ratio (R) of as small as about 0.11. In contrast, the naphthalate polyester fibers of this invention (curve 1) have a unique peak at $2\theta = 18.7°$, and a diffraction intensity ratio (R) of about 3.10 which is considerably higher than that of the conventional naphthalate polyester fibers.

The fibers of this invention, owing to their novel crystalline structure described above, retain a sufficient tenacity (at least 4.4 *g/de*), and have a higher elongation than the conventional fibers. If the tenacity of the fibers is expressed as T (*g/d*) and their elongation, as E (%), the fibers have a toughness, as expressed by T × E, of at least 21.5, and the value E becomes more than 11 to 40%. The conventional naphthalate polyester fibers having an R value of, say, about 0.12, have a toughness of at most about 21, and it is impossible to increase their tenacity without a decline in elongation.

The naphthalate polyester fibers of this invention show a second yield point in their load-elongation curve. It is clear from FIG. 2 that the load-elongation curve 1 of the naphthalate polyester fibers of this invention shows two yield points at A and B. Point A is a primary yield point, and point B, a secondary yield point.

In contrast, the load-elongation curve 2 of the conventional naphthalate polyester fibers and the load-elongation curve 3 of naphthalate polyester fibers having an R value of at most 1.73, both show only one yield point.

In other words, the naphthalate polyester fibers of this invention excel the conventional naphthalate polyester fibers in resistance to impact and resistance to fatigue.

Because of their novel crystalline structure, the naphthalate polyester fibers of this invention have much higher melting points than the conventional naphthalate polyester fibers, which are at least 275° C., usually at least 280° C.

The "melting point", as referred to in the present invention, is the temperature at which an endothermic peak appears in the DSC curve determined with respect to 8.5 mg of the sample weight at a heating rate of 10° C./min. using a Perkin-Elmer testing apparatus (DSC-1 type).

Furthermore, the fibers of this invention have the advantage that they suffer little from a reduction in tenacity at high temperatures. For example, when the conventional naphthalate polyester fibers are treated for 6 hours in wet heat at 150° C., the tenacity retention is less than 50%. But when the fibers of the present invention are treated in the same way, the tenacity retention is increased to about 60% or more. The fibers of this invention also have superior light stability to the conventional naphthalate polyester fibers.

The naphthalate polyester fibers of this invention have superior dyeability to the conventional naphthalate polyester fibers. The dye exhaustion of the conventional naphthalate polyester fibers with dispersed dyes is 25% at most, whereas that of the naphthalate polyester fibers of this invention is as high as at least 40%.

The dye exhaustion is measured as follows: The sample fibers are dyed with a dyeing bath containing 4% (based on the weight of the fibers) of Dispersol Fast Scarlet B (dispersed dye) and 0.5 g/l of a dispersant (MONOGEN) at 100° C. for 90 minutes, with the ratio of the fibers to the dye liquor being adjust to 1 : 100. To 2 cc of the liquor remaining after dyeing is added 2 cc of acetone, and the mixture is diluted to 50 cc using an aqueous solution of acetone in which the ratio of acetone to water is 50 : 50. The optical density (OD) of this solution is measured by a spectrophotometer. The dye exhaustion is expressed by the following equation (2).

$$\text{Dye exhaustion (\%)} = \left(1 - \frac{OD_R}{OD_B}\right) \times 100 \qquad (2)$$

wherein $OD_R$ and $OD_B$ are the optical densities of the residual liquor remaining after dyeing and the dyeing solution.

If the R value of the naphthalate polyesters is less than 1.73, the melting point does not increase, and there is no improvement in resistance to impact and resistance to fatigue.

Naphthalate polyester fibers having an R value of at least 5.0 cannot be obtained.

In addition to the above-mentioned properties, the naphthalate polyester fibers of this invention have high chemical resistance, good dimensional stability to heat and load, high initial Young's modulus and low moisture regain.

The fibers of this invention can be in the form of any of monofilaments, staple fibers, tows, multifilament yarns and spun yarns.

The fibers of this invention may be circular or non-circular in cross sectional shape, or hollow fibers.

The denier size of the fibers of this invention is 0.5 to 100 denier/filament.

The novel naphthalate polyester fibers of this invention can be prepared by melt-spinning a naphthalate polyester having an intrinsic viscosity of 0.45 to 1.0 and containing at least 85 mol % of ethylene-2,6-naphthalate units from a spinneret each orifice of which has a sectional area (A) of 0.049 to 3.14 mm² at a spinning temperature (T) which satisfies the following equation 3

$$28.6\,[\eta] + 301.4 \geqq T \geqq 35.7\,[\eta] + 279.3 \qquad (3)$$

wherein $T$ is the spinning temperature in 0° C., and $[\eta]$ is the intrinsic viscosity of the polyester, and at a take-up speed (W) of 3,000 to 12,000 m/min.

The spinning temperature, as referred to herein, is the temperature of the polymer at the exit of the spinning nozzle. Usually, however, this temperature is substantially equal to the temperature of the spinneret, and therefore, the temperature of the spinneret can be regarded as the spinning temperature.

The take-up speed, as referred to herein, is the speed of travelling of the extruded filament at a stage where the filament has been completely cooled and solidified. When the filament is taken up by Godet rollers, this speed can be expressed by the speed of the running filament on these rollers, and when it is taken up by an air aspirator, it is expressed by the speed of the running filament in the aspirator.

It the spinning temperature (T) is less than the lower limit defined in the equation 3 above, fibers having an R value of at least 1.73 and having good physical properties cannot be obtained. If it is higher than the upper limit defined in the equation (3), the decomposition of the polymer, and drip or kneeling, etc. occur, and satisfactory spinning cannot be performed.

If the sectional area (A) of the orifice is less than 0.049 mm², blockage of the orifices frequently occurs, and the spinning cannot be carried out in good condition. On the other hand, if it is larger than 3.14 mm², the extruding of the polymer becomes increasingly abnormal, and the extruded filaments become increasingly non-uniform.

For obtaining good extrusion, it is preferred that the spinning temperature (T° C.) should be selected so that it meets the requirement of the equation (3) and also satisfies the following equation 4

$$T \geqq (73.8\,[\eta] - 88.6)\sqrt{A} + 331.6 \qquad (4)$$

wherein

A is the sectional area (mm²) of one spinning orifice, and T and $[\eta]$ are the same as already defined.

If the take-up speed is slower than 3,000 m/min., the R value of the resulting fibers decreases discontinuously. If it is faster than 12,000 m/min., the extruded filaments are only insufficiently cooled, and stable take-up becomes impossible.

The spinning described above is performed at a draft ratio (D) of 50 to 20,000. Especially, the draft ratio satisfying the following equation 5 is preferred.

$$-7.43 \times 10^{-5}W + 2.37 \leqq \log D \leqq 2.27\sqrt{A} + 1.98 \qquad (5)$$

wherein

D is the draft, W is the take-up speed (m/min.) of the filament, and A is the cross sectional area (mm²) of one spinning orifice.

The extruded filaments cool spontaneously, and may be cooled positively.

The extruded filaments may be interlaced to give them twist-free coherency.

The fibers obtained may be gathered by wind-up or other customary means in the twisted or non-twisted state.

The fibers so gathered have the excellent characteristics described in the present invention in their undrawn state. Drawing may result in the deterioration of these characteristics, and therefore, the fibers should not be drawn.

If desired, the fibers may be heat-treated, or shrunken.

Since the fibers of this invention have a greatly improved toughness and superior thermal stability, dyeability and resistance to wet heat, various troubles (such as the occurrence of fuzzes, or the reduction of tenacity) in the processing of the fibers, such as in weaving or knitting operation, can be avoided. Tus, these fibers give textile articles which are useful for apparel and industrial applications which require thermal stability or resistance to heat. Examples of the applications of the fibers of this invention based on their good resistance to heat and dyeability are working wear and carpet for high temperatures, and based on their good heat and chemical resistance, are high temperature gas filters. They are especially useful for electrical insulating materials because of their low moisture regain. Furthermore, these fibers are useful for papermaking canvas or filters for hot water, because of their good resistance to wet heat. Furthermore, because of their high toughness and fatigue resistance, they are suitable for uses as a reinforcing material for rubber goods such as tires, V-belts, flat-belts, conveyor belts, hoses, vehicle hoods or working overshoes, or a reinforcing material for synthetic resin articles. Furthermore, by utilizing their high heat-insulating properties they can be used as heat-insulating materials, and by utilizing their high Young's modulus, they can be used as a stuffing material of cushioning materials.

The novel naphthalate polyester fibers of this invention are made into a fibrous cloth and a sleeve in order to use them for the various applications mentioned above. The fibrous cloth can be easily produced by a weaving, knitting or felting process employed usually for processing other synthetic fibers.

The operability at the time of weaving, knitting or felting of these fibers is the same as, or better than, that at the time of processing polyethylene terephthalate fibers. The appearance and handling properties of the resulting fibrous clothes and sleeves also prove comparable to other synthetic fibers.

The fibers of this invention can be made, as mentioned above, into woven fabrics of optional textures such as plain weave, twill weave or satin weave, knitted fabrics such as circular knitted goods, or non-woven fabrics by bonding through needle-punching or using an adhesive or heat.

The step of producing these non-woven fabrics can be connected with the spinning step. These fibrous cloths or sleeves may be of the interwove, inter-knitted, mix-woven, or mix-spun type. Or they may be laminated to films or paper.

These fibrous cloth or sleeves is then subjected to such a step as boiling in loop, roller drying, or heat-treatment. Of these, the heat-treatment especially exerts a great influence on the properties of the fibrous cloth obtained, and the properties of it in subsequent processing steps, that is, shrinkage, flatness, and dimensional stability against heat.

Needless to say, the heat-treatment conditions are defined by the heat-treatment temperature (T° C) and the heat-treating time (t in seconds), and it has been found that the effective heat-treatment temperature in the present invention is not lower than 205° C. but below the melting point of the fibers. Extensive experiments were conducted as to the heat-treatment time at various temperature levels. As a result, it was found that by heat-treating the fibrous cloth under conditions which meet the following two equations 6 7, there can be obtained a cloth of naphthalate polyester fibers which has superior heat resistance and mechanical strength, and also flatness, dimensional stability against heat and low shrinkage, and which has uniform texture and especially suitable as electrical insulating materials.

$$T-2:5 \geqq 70e^{-2 \log 10 t} \quad (6)$$

$$T-Tm \leqq -70e^{-2(4-\log 10 t)} \quad (7)$$

wherein

*e* is the base of a natural logarithm.

Now referring to FIG. 3 which shows the relation between the heat-treating temperature and the heat-treating time, the hatched portion surrounded by curves (I) and (II) corresponding to the equations 6 and 7 above shows a combination of the heat-treating temperature and the heat-treating time, which is closely related to the properties of the heat treated cloth, that is, dimensional stability against heat, stability, shrinkage and flatness.

When this relation between the heat-treating temperature and the heat-treating time is not satisfied that is, when the relation is shown by portions outside the hatches one, the properties of the heat-treated cloth are not satisfactory for practical purposes.

The heat-treated fibrous cloth subjected to the heat-treatment meeting the above-mentioned temperature and time requirements can be expected to have improved heat dimensional stability, shrinkage and flatness of the fibrous cloth. Thus, varnishes can be uniformly impregnated in the resulting clothes. When the cloths are cut into the form of tapes, it is easy to cut them to have a straight edge.

The heat-treatment under conditions defined by the equations 6 and 7 above can be performed by using a known apparatus such as a tenter (a blast-furnace type heat-treating device or a roll-type heattreating device). The heat-treatment can be performed either under tension or while allowing a restricted shrinkage. Since the naphthalate polyester cloth, when heat-treated while allowing a restricted shrinkage, tends to have a reduced tenacity, the shrinkage should preferably be limited to not more than 15% of the original length. If it exceeds 15%, the above-mentioned advantages cannot be obtained. The above-mentioned heat-treatment may be performed continuously during the course of processing the fibers, such as weaving or scouring, or before or after converting the fibers into a final product such as electrical insulating materials.

The naphthalate polyester clothes and sleeves of this invention have sufficient heat resistance as compared with the conventional fibrous electrical insulating materials of grade B or F, and possess far superior mechanical properties and processability. Thus, they can contribute to the small size and light weight of the machinery and can be used in the machinery of grade F.

Attempts have been made to provide naphthalate polyester cloths impregnated with a varnish, which have pliability, flexibility, and heat resistance of grade B or F, and which sufficiently retain their properties even under wet conditions. As a result, we have found that such naphthalate polyester cloths can be obtained by impregnated the naphthalate polyester cloths with a varnish of the alkyl, polyurethane, epoxy acrylonitrile, and silicone type and also a heat-resistant varnish of the heterocyclic type either alone or in combination.

The naphthalate polyester cloths impregnated with the varnish have superior mechanical properties i.e., large tensile strength, Young's modulus, rupture strength, tear strength and bending strength, and also good thermal properties and dimensional stability, and exhibits stable electrical properties over a wide range of temperatures. Furthermore, the naphthalate polyester substrate-cloth has sufficient resistance to various varnishes, insulated oil, freon, refregerator oils, various organic solvents and plasticizers. Thus, by a proper choice of varnish according to the purpose of application, there can be obtained a fibrous insulating material which is far more functional than the conventional varnishimpregnated cloth. Furthermore, this fibrous insulating material has handling and processing properties equal to, or even better than, those of the conventional materials which have found wide applications. The varnish-impregnated fibrous cloth obtained by this invention is also comparable to the conventional varnish-impregnated cloths having heat resistance ranked in grade B or F, and can be used as an electrical insulating material having far better functions in mechanical properties, processability, quality, and the quantity that can be supplied.

The electrical insulating material of this invention can be used as cloth, cloth tape, cloth tube, or sleeve in the form of a naphthalate polyester fibrous cloth alone, or as varnish cloth, varnish cloth tape, varnish cloth tube, or laminating pre-preg in the form impregnated with a varnish. The electrical insulating material of this invention can also be used as laminates or other processed articles obtained by bonding or melt-bolding, using an organic material such as films or an inorganic insulating material such as glass, asbestos, mica. Also, it will be used in other specific fields by incorporation of various anti-exidants or fire-retarding agents.

The fibers of this invention can be used in the form of mixed yarns with another kind of fibers in such a process as mix-weaving, inter-weaving or mix-spinning. Or they can be mixed with other fibers in the stage of knitting or weaving in such a process as interknitting or interweaving. Or they may be made into non-woven fabrics containing other fibers.

Furthermore, the heat resistance, flame resistance and Young's modulus of the naphthalate polyester fibers of this invention can be improved by mixing them with aromatic polymide fibers, aromatic polyamideimide fibers, aromatic fibers, polyamide fibers, fluorine-polymer fibers, glass fibers, carbon fibers or metal fibers. Or they may be mixed with other low-melting fibers, and heat-fused.

The invention will now be described specifically by the following Examples, which will further demonstrate the above-mentioned advantages of this invention. The different intensity distribution curve in the equatorial direction according to the X-ray diffraction method, to loadelongation curve, melting point, melting point under constant length, resistance to wet heat, resistance to dry heat, dye exhaustion and flame retardancy were determined by the following methods.

X-ray Diffraction Pattern

Device: Model D-9C (device produced by Rigaku Denki Kabushiki Kaisha)
Filter: nickel filter
Power: 35 KV, 20 mA
Divergence slit: 0.15 mm $\phi$
Scattering slit: 1°
Receiving slit: 0.4 mm
Wave length,$\lambda$: 1.542 A
Load-Elongation Curve
Length of the sample: 20 cm
Fulling speed: 100 %/min. at 25° C. and Relative Humidity (RH) 65%

In the break strength obtained from the load-elongation curve, a reduction in denier incident to the rising of the elongation is not corrected.

Melting point

The melting point of the sample fibers (sample weight: 8.5 mg) is measured by a calorimeter (Perkin-Elmer, DSC-1) while heating them at a rate of 10° C./min. The sample is in the free state during the measurement, and the temperature at which an endothermic peak occurs is read from the DSC curve obtained.

Melting point measured under constant length of fibers

The same as the measurement of the melting point above, except that the sample fibers are maintained at constant length during measurement.

Resistance to wet heat

The specimen is put into water, and treated at 150° C. for 6 hours without restricting its length in a closed vessel (autoclave), and the tenacity retention of the specimen is measured.

Resistance to dry heat

The specimen is treated under constant length in a hot air bath at 150°, 230°, 250° C. for 60 minutes, and the tenacity retention of the specimen is measured.

Dye exhaustion
Dispersed dye: Dispersol Fast Scarlet B 4% (o.w.f.)
Dispersant: Monogen 0.5 g/*f*
Goods-to-liquor ratio: 1 : 100
Dyeing temperature: 100° C.
Dyeing time: 90 minutes Under the above conditions, the sample fibers are dyed. To 2 cc of the residual liquor after the dyeing is added 2 cc of acetone, and the solution is diluted to 50 cc with an aqueous solution consisting of acetone/water in a ratio of 50 : 50. The optical density (OD) of the solution is measured using a spectrophotometer, and the dye exhaustion is calculated from the following equation.

$$\text{Dye exhaustion (\%)} = \left(1 - \frac{OD_R}{OD_B}\right) \times 100$$

wherein $OD_R$ and $OD_B$ are the optical densities of the residual liquor after dyeing and of dyeing liquor before dyeing.

Flame retardancy
Number of ignitions: ASTM D 1230-61
Limiting oxygen concentration index (LOI): ASTM D2863-70

Electrical and Mechanical Properties of Varnish-Impregnated Cloth

1. Tensile strength and elongation

A tensile test is performed in a room at 23° C. and 50% RH at a pulling spaced of 200 mm/min. with the width of the sample and the holding span being adjusted to 15 mm and 150 rm respectively. The strength and elongation at the time of breakage are measured. (JIS C-2318)

2. Mullen's bursting strength

Measured in accordance with JIS T-8112 in a room at 23° C. and 50% RH.

3. Schopper bending strength

Measured in accordance with JIS T-8114 in a room at 23° C. and 50% RH.

4. Volume REsistivity

A potential of 500 V is applied to the specimen at 20° C., and a leaked current after one minute is measured. The volume resistivity is obtained by dividing the voltage by the current. (JIS C-2318)

5. Dielectric Breakdown Strength

Voltage is raised from zero at a rate of 500 V/sec. to 1000 V/sec. The strength is obtained by dividing the voltage which induces short-circuit, by the thickness of the specimen. (JIS C-2318)

EXAMPLE 1

Polyethylene-2,6-naphthalate having an intrinsic viscosity of 0.645 was melt-spun at a spinning temperature of 315° C. through a spinneret having circular spinning orifices each with a diameter of 0.4 mm and a cross sectional area of 0.1256 mm², and the extruded filaments were taken up at various take-up speeds. The physical properties of the resulting fibers are shown in Table 1.

Table 1

| Run Nos. | 1 | 2 | 3 | 4 |
|---|---|---|---|---|
| Take-up speed (m/min.) | 1000 | 3000 | 4000 | 5000 |
| Draft ratio | 145 | 470 | 620 | 765 |
| Denier/filament (de) | 9.64 | 2.91 | 2.22 | 1.79 |
| Tenacity (g/de) | 2.03 | 5.64 | 6.34 | 6.78 |
| Elongation (%) | 173 | 23.5 | 18.7 | 11.6 |
| Toughness (g $\sqrt{\%/de}$ ) | 26.7 | 27.5 | 27.4 | 23.1 |
| Young's modulus (Kg/mm²) | 500 | 1380 | 1600 | 1750 |
| Shrinkage in boiling water (%) | 25.0 | 2.0 | 2.0 | 2.0 |
| Heat resistance (tenacity retention) | | | | |
| wet 150° C. × 6 hrs. | filament melt-adhered | 78.5 | 77.6 | 74.6 |
| dry 250° C. × 1 hr. | filament melt-adhered | 76.6 | 74.9 | 72.7 |
| Dye exhaustion (%) | 75.8 | 49.6 | 56.1 | 58.0 |
| R value | 0.058 | 4.56 | 4.47 | 4.09 |
| DSC melting point (° C) | 267.0 | 281.4 | 284.7 | 290.5 |
| DSC melting point measured under constand length (° C) | 273.1 | 286.4 | 289.7 | 293.6 |

Run Mo 1 relates to fibers having an R value of less than 1.73 employed as a comparison, and Run Nos. 2 to 4 concern to fibers of this invention.

EXAMPLE 2

Polyethylene-2,6-naphthalate having an intrinsic viscosity of 0.70 was melt-spun at various spinning temperatures through a spinneret having six circular spinning orifices each with a diameter of 1.2 mm and a cross sectional area of 1.13 mm² at a draft ratio of 5630, and the extruded filaments were taken up at a speed of 4000 m/min. The physical properties of the fibers obtained are shown in Table 2.

Table 2

| Run Nos. | 5 | 6 | 7 | 8 |
|---|---|---|---|---|
| Spinning temperature (° C) | 300 | 310 | 320 | 325 |
| Tenacity (g/de) | 5.83 | 6.16 | 6.43 | |
| Elongation (%) | 9.0 | 15.2 | 17.1 | |
| Toughness (g $\sqrt{\%/de}$ ) | 17.5 | 24.1 | 26.6 | |
| Young's modulus (Kg/mm²) | 1630 | 1580 | 1570 | Spinning conditions bad, and wind-up impossible |
| Shrinkage in boiling water (%) | 3.0 | 2.1 | 2.0 | |
| R value | 0.292 | 4.50 | 4.41 | |
| Melting point (° C) | 274.1 | 284.2 | 285.5 | |
| Dye exhaustion (%) | 34.6 | 57.5 | 59.0 | |

Runs Nos. 5 and 8 are comparisons.

The same fibers are used in Run No. 7 were subjected to wet heat treatment to the free state and dry heat treatment under constant length, and the percentage retention of the tenacity and Young's modulus was determined. The results are given in Table 3.

Table 3

| Treatment conditions | | Tenacity (g/de) | Retention (%) | Young's modulus (Kg/mm²) | Retention (%) |
|---|---|---|---|---|---|
| Non-treated | | 6.43 | — | 1570 | — |
| Wet heat | 150° C × 6 hrs. | 4.94 | 76.8 | 1360 | 86.5 |

Table 3-continued

| Treatment conditions | | Tenacity (g/de) | Retention (%) | Young's modulus (Kg/mm²) | Retention (%) |
|---|---|---|---|---|---|
| Dry heat | 150° C × 1 hr. | 6.17 | 96 | 1480 | 94.2 |
| | 230° C × 1 hr. | 5.93 | 92.3 | 1570 | 100 |
| | 250° C × 1 hr. | 4.92 | 76.6 | 1480 | 94.2 |

It is clearly seen from Tables 1 and 2 above that the fibers of this invention have a high melting point, high tenacity and elongation and small shrinkage in boiling water. Table 3, on the other hand, demonstrates that the retention of the tenacity and the Young's modulus of the fibers of this invention at high temperatures is very high.

EXAMPLE 3

Polyethylene-2,6-naphthalate having an intrinsic viscosity of 0.67 was melt-spun at a spinning temperature of 315° C., and the extruded filaments were taken up at a speed of 3500 m/min. At this time the cap diameter was changed, and the effect of the draft ratio on the physical properties of the resulting fibers was examined. The results are shown in Table 4.

Table 4

| Run Nos. | Cap diameter (mm) | Draft ratio | Tenacity (g/de) | Elongation (%) | Toughness (g $\sqrt{\%/de}$) | R value | m.p. (° C) | denier/filament (de) |
|---|---|---|---|---|---|---|---|---|
| 9 | 0.23 | 216 | Spinning conditions poor (occurrence of brittle filaments) | | | | | |
| 10 | 0.40 | 653 | 6.04 | 20.5 | 27.4 | 3.84 | 281.0 | 2.07 |
| 11 | 0.70 | 1995 | 6.51 | 16.2 | 26.2 | 3.25 | 284.6 | 2.08 |
| 12 | 1.20 | 5860 | 6.87 | 12.1 | 23.9 | 2.75 | 287.3 | 2.06 |
| 13 | 2.40 | 23500 | Spinning conditions poor (occurrence of drip, kneeling, etc.) | | | | | |

Runs Nos. 9 and 13 are comparisons.

EXAMPLE 4

Polyethylene-2,6-naphthalate having an intrinsic viscosity of 0.638 was melted using an extruder-type melter, and melt-extruded from a spinneret having circular spinning orifices each with a diameter of 0.5 mm, at a spinning temperature of 312° C. A quenching air (25° C. RH of 60%) was applied to the filaments, and an aqueous emulsion was adhered thereto. The filaments were interlaced to impart coherency, and wound up in the form of a twist-free cheese at a take-up rate of 3000 m/min. and 8000 m/min. The properties of the resulting filaments are shown in Table 5 below. (Run. Nos. 14 and 15)

The filaments of Run No. 14 were drawn to 1.2 times the original length using a pin (held at 145° C) and a plate (held at 185° C), and heat-treated. The properties of the resulting filaments are also shown in Table 5 as Run No. 16.

Table 5

| Run No. | 14 | 15 | 16 |
|---|---|---|---|
| Take-up speed (m/min.) | 3000 | 8000 | — |
| Draft ratio | 470 | 1250 | — |
| denier/filament (de) | 8.83 | 3.31 | 7.38 |
| Tenacity (g/de) | 5.61 | 8.03 | 6.78 |
| Elongation (%) | 21.5 | 11.2 | 8.9 |
| | 26.0 | 26.9 | 20.2 |
| Toughness (g $\sqrt{\%/de}$) | | | |
| R value | 4.50 | 3.66 | 0.11 |

Table 5-continued

| Run No. | 14 | 15 | 16 |
|---|---|---|---|
| Melting point (° C) | 281.5 | 291.7 | 282.7 |

EXAMPLE 5

Polyethylene-2,6-naphthalate having an intrinsic viscosity of 0.60 having copolymerized therewith 2 mol % of trimethyl phosphate was melt-spun at a spinning temperature of 310° C, through a spinneret having 48 circular orifices each with a diameter of 0.4 mm, and taken up at a speed of 3000 m/min. while applying a draft ratio of 483. (Run No. 17) For comparison, polyethylene-2,6-naphthalate having an intrinsic viscosity of 0.60 was melt-spun and taken up under the same conditions (Run No. 18). The physical properties of the fibers obtained are shown in Table 6.

Table 6

| Run No. | 17 | 18 |
|---|---|---|
| Denier/filament (de) | 2.85 | 2.89 |
| Tenacity (g/de) | 5.26 | 5.45 |
| Elongation (%) | 25.3 | 21.6 |
| | 26.5 | 25.4 |
| Toughness (g $\sqrt{\%/de}$) | | |
| R value | 3.68 | 4.51 |
| Melting point (° C) | 278.5 | 280.6 |
| Number of ignitions | 6,5,4,6,4 | 4,2,4,3,4 |
| LOI | 34 | 25 |

The fibers of Runs Nos. 17 and 18 were knitted, and the number of ignitions and LOI were measured. The results are also shown in Table 6. The fabric containing the phosphorus compound exhibited good flame retardancy.

EXAMPLE 6

Polyethylene-2,6-naphthalate having an intrinsic viscosity of 0.64 was melt-extruded at a spinning temperature of 315° C, through a spinneret having 24 circular orifices each with a diameter of 0.27 mm, and taken up at a speed of 2,000 m/min. and 3,000/min. The physical properties of the resulting fibers are shown in Table 7.

Table 7

| Run Nos. | 19 | 20 |
|---|---|---|
| Take-up speed (m/min.) | 2000 | 3000 |
| Draft ratio | 170 | 255 |
| Denier/filament (de) | 2.97 | 1.98 |
| Tenacity (g/de) | 2.64 | 5.12 |
| Elongation (%) | 90.8 | 30.3 |
| | 25.1 | 28.2 |
| Toughness (g $\sqrt{\%/de}$ ) | | |
| Young's modulus (Kg/mm²) | 680 | 1350 |
| Shrinkage in boiling water (%) | 37.3 | 2.1 |
| R value | 0.13 | 4.68 |
| Melting point (° C) | 271.0 | 279.8 |

Run No 19 is a comparison.

These fibers were twisted, roller-sized, and woven in accordance with the usual method to produce woven cloths having a density of 72 × 31 yarns/inch and a width of 101 cm. The cloths were suspended and scoured in hot water, dried, and heat-treated at 235° C. at a speed of 20 m/min. in a pin-tenter 15 meters long. The physical properties of the woven cloths are shown in Table 8 (Runs Nos. 21 and 24).

Table 8

| Run No. | | 21 | 22 | 23 | 24 | 25 | 26 |
|---|---|---|---|---|---|---|---|
| Fibers used in Run Nos. | | 19 | 20 | 20 | 20 | 20 | 20 |
| Tensile strength (Kg/cm²) | | | | | | | |
| | warp | 110 | 180 | 740 | 740 | 790 | 530 |
| | weft | 80 | 170 | 730 | 680 | 700 | 510 |
| Tensile elongation (%) | | | | | | | |
| | warp | 75–95 | 13 | 25 | 27 | 17 | 16 |
| | weft | 70–90 | 13 | 31 | 35 | 19 | 26 |
| Tensile elasticity (Kg/cm² × 10³) | | | | | | | |
| | warp | 1.2 | 1.8 | 16 | 15 | 16 | 15 |
| | weft | 1.1 | 1.7 | 12 | 11 | 13 | 12 |
| Elemendorf's tear strength (Kg) | | | | | | | |
| | warp | 0.1 | 0.4 | 0.8< | 0.9< | 0.7< | 0.8< |
| | weft | 0.1 | 0.5 | 1.0< | 1.1< | 0.9< | 1.0< |
| Shrinkage in dry heat (250° C × 1 hr) (%) | | 30.5 | 10.2 | 1.7 | 2.2 | 2.0 | 2.3 |
| Flatness (observed with the naked eye) | | poor | poor | good | good | poor | good |
| Heat-treatment conditions | | | | | | | |
| Temperature (° C) | | 235 | 205 | 270 | 235 | 275 | 235 |
| Time (seconds) | | 45 | 5 | 10 | 45 | 1200 | 45 |

Runs Nos. 21, 22 and 25 are comparisons. Run No. 26 indicates the results, after having treated the cloth at 230° C. for 30 days, using a gear ageing tester.

The physical properties of the woven cloth made from the fibers of Run. No. 20 were measured with respect to varying heat-treatment conditions, and the results are given in Table 8.

The woven cloth of Run No. 24 was heat-degraded in air at various high temperatures, and a part of the results obtained is shown in Table 8 under Run No. 26.

The above results demonstrate that these cloths can be sufficiently used as a heat-resistant material ranked in grade F (155° C.).

EXAMPLE 7

Each fiber of Example 6, Run Nos. 19 and 20 was mixed with 15% by weight of poly-m-phenylene isophthalamide fibers (Cornex of Teijin Limited, 100 de/50 fils, tenacity 5.3 g/de, elongation 22%), and the mixture was woven, followed by twisting, roller sizing and drawing-in by a customary method to form woven cloths having a density of 72 × 31 yarns/inch and a width of 101 cm. The woven cloths were suspended and scoured in hot water. After drying, the cloths were heat-treated at 235° C. at a rate of 20 m/min. in a pin tenter, 15 meters long.

The properties of the resulting woven cloths are shown in Table 9.

Table 9

| Run Nos. | | 27 | 28 |
|---|---|---|---|
| Fibers used in Run Nos. | | 19 | 20 |
| Tensile strength (Kg/cm²) | | | |
| | warp | 125 | 750 |
| | weft | 115 | 690 |
| Tensile elongation (%) | | | |
| | warp | 55–65 | 25 |
| | weft | 45–50 | 33 |
| Tensile elasticity (Kg/cm² × 10³) | | | |
| | warp | 1.0 | 12 |
| | weft | 0.8 | 11 |
| Elemendorf's tear strength (Kg) | | | |
| | warp | 0.3 | 1.0< |
| | weft | 0.2 | 1.1< |
| Dry-heat shrinkage (%) (250° C × 1 hr.) | | 18.1 | 1.4 |

EXAMPLE 8

The same naphthalate polyester cloth as used in Run No. 24, Example 6, was impregnated with a varnish (a copolymer of methyl phenyl siloxane and alkyd, i.e. alkyd-modified silicone varnish; commercially available under the trade mark KR 206, Shinetsu Kagaku Kabushiki Kaisha), and the varnish-impregnated cloth was dried at 120° C. for 7 minutes. Furthermore, it was baked at 200° C. for 26 minutes. The amount of the varnish impregnated was 2.7 times the weight of the base cloth. As a comparison, a woven cloth of polyethylene terephthalate filaments (50 de/24 fils) was used as a base cloth, and impregnated and dried under the same conditions as above. The characteristics of both cloths were compared. The results are shown in Table 10. The results demonstrate that the cloth of this invention can be sufficiently used as a heat resistant material ranked in grade F (155° C), but the comparative cloth cannot give desirable results.

Table 10

| Characteristics | Naphthalate polyester cloth | | Polyethylene terephthalate cloth (comparison) | |
|---|---|---|---|---|
| | Initial value | after 210° C × 7 days | Initial value | after 210° C × 7 days |
| Tensile strength (15 mm width, Kg/cm²) | 680 | 420 | 490 | 150 |
| Tensile elongation (15 mm width, %) | 28 | 19 | 38 | 5 |
| Schopper bending strength (times) | $10^3$< | 800 | $10^4$< | completely degraded |
| Mullen's bursting strength (Kg/cm²) | 8 < | 6 | 8 < | 1.3 |
| Volume resistivity (ohm-cm) | $3.1 \times 10^{15}$ | $2.9 \times 10^{15}$ | $3.2 \times 10^{15}$ | $4.0 \times 10^{15}$ |
| Dielectric breakdown strength (KV/mm) | 60 | 53 | 60 | 0 |

EXAMPLE 9

Polyethylene-2,6-naphthalate having an intrinsic viscosity of 0.58 was melt-extruded at a spinning temperature of 303° C. through a spinneret having 48 circular orifices each with a diameter of 0.4 mm, and interlaced to various degrees to impart coherency. Then, the interlaced filaments were wound up at a take-up speed of 3000 m/min. while applying a draft ration of 653. The properties of the resulting filaments are shown in Table 11.

Table 11

| Run Nos. | 29 | 30 | 31 |
|---|---|---|---|
| Degree of interlacing* (number/m) | 0 | 4 | 10 |
| Denier/filament (de) | 5.20 | 5.22 | 5.24 |
| Tenacity (g/de) | 5.21 | 5.18 | 5.09 |
| Elongation (%) | 20.3 | 19.8 | 18.3 |
| Toughness (g $\sqrt{\%/de}$ ) | 23.5 | 23.1 | 21.7 |
| R value | 4.33 | 4.35 | 4.36 |
| Melting point (° C) | 280.6 | 280.4 | 280.7 |

*In accordance with the method of British Patent 924,089.

After twisting the fibers, a sleeve having an inside diameter of 2.0 mm was woven therefrom using 24 pirrs. The interlaced fibers gave a sleeve free from fuzzes, and the weavability was good. The sleeves obtained can be sufficiently used as heat resistant material ranked in grade F (155° C).

EXAMPLE 10

Polyethylene-2,6-naphthalate having an intrinsic viscosity of 0.638 was melt-spun at a spinning temperature of 308° C, through a spinneret having 48 circular orifices each with a diameter of 0.4 mm. The extruded filaments were given a predetermined speed by means of a pair of Nelson rolls, and while being sucked, spread and dispersed by an air jet nozzle, they were gathered and accumulated to form a web of filaments. The web was needle-punched to form a non-woven cloth. The properties of the resulting filaments and non-woven cloths are shown in Table 12.

Table 12

| Run Nos. | 32 | 33 | 34 |
|---|---|---|---|
| Take-up speed (m/min.) | 2000 | 3000 | 4000 |
| Properties of a filament | | | |
| Denier | 2.24 | 2.28 | 2.19 |
| Tenacity (g/de) | 2.54 | 5.32 | 6.14 |
| Elongation (%) | 96.4 | 25.1 | 19.2 |
| Toughness (g $\sqrt{\%/de}$ ) | 24.8 | 26.7 | 26.9 |
| Shrinkage in boiling water | 44.5 | 1.9 | 1.8 |
| R value | 0.08 | 4.45 | 4.38 |
| Melting point (° C) | 268 | 280.9 | 285.0 |
| Properties of the non-woven cloth | | | |
| Area shrinkage (dry-heat at 175° C) | 34.4 | 3.4 | 3.2 |
| Heat resistance (tenacity retention) (%) | | | |
| Wet 150° C × 6 hrs. | filament | 79.5 | 78.4 |
| Dry 250° C × 1 hr. | melt-adhered | 77.4 | 75.6 |

Run No. 32 is a comparison, covering the fibers having an R value of less than 1.73. Run Nos. 33 and 34 cover the fibers of this invention.

EXAMPLE 11

Polyethylene-2,6-naphthalate having an intrinsic viscosity of 0.67 was melt-spun at a spinning temperature of 315° C. through a spinnert having 48 circular orifices each with a diameter of 0.55 mm, and wound up at a take-up speed of 7500 m/min.

Four of the resulting yarns were associated into one thick yarn, and using two of such thick yarns, a cord (S × Z twisted at 30 × 30 T/10 cm) was prepared. 2.0 grams of the cord and 1.0 ml. of water were sealed into a 20 ml. glass tube. The sealed tube was immersed for 4 hours in an oil bath kept at 180° C. Then, the tenacity retention was determined.

The cord was treated with an adhesive containing rubber latex, resorcinol and formalin, and interposed between natural rubber plates, followed by heat-treating for 25 minutes at 235° C. under a load of 50 Kg/cm². The properties of the resulting yarns and cords, and the tenacity retention are shown in Table 13.

COMPARATIVE EXAMPLE

Filaments from the same polymer extruded under the same conditions as in Example 11 were wound up at a take-up speed of 350 m/min.

The undrawn filaments were drawn at the following temperatures and draw ratios, at a drawing speed of 100 m/min.

| | Draw temperature | Draw ratio |
|---|---|---|
| 1st step | 140° C. (hot pin) | 4.61 |
| 2nd step | 190° C. (hot plate) | 1.37 |
| 3rd step | 210° C. (hot plate) | 1.00 |

The yarns obtained were twisted into cords under the same conditions as employed in Example 11, and subjected to heat-degradation tests.

the properties of the yarns and cords, and the tenacity retention of the cords after heat-degradation are shown in Table 13.

Table 13

| Run Nos. | 35 | Comparison |
|---|---|---|
| Properties of the yarn | | |
| Denier size (de/filaments) | 255/48 | 262/48 |
| Tenacity (g/de) | 8.01 | 8.35 |
| Elongation (%) | 11.3 | 6.1 |
| R value | 3.71 | 0.02 |
| Melting point (° C) | 291.4 | 278 |
| Properties of the cord | | |
| Tenacity retention, prepared into the cord (%) | 82.6 | 77.6 |
| Elongation (%) | 16.4 | 11.5 |
| Tenacity retention, treated | 40.1 | 34.5 |

Table 13-continued

| Run Nos. | 35 | Comparison |
|---|---|---|
| in the sealed tube (%) | | |
| Tenacity retention, treated in the rubber (%) | 55 | 48 |

What we claim is:

1. A process for producing a naphthalate polyester filament, fiber or yarn having a diffraction intensity ratio (R) between a Bragg reflection angle $\theta = 18.7°$ and $\theta = 15.6°$, as determined by the X-ray diffraction method, being in the range of more than 1.73 and up to 5.00, which comprises melt-spinning a naphthalate polyester containing at least 85 mol % of ethylene-2,6-naphthalate units and having an intrinsic viscosity of 0.45 to 1.0, using a spinning nozzle having a cross sectional area of 0.049 to 3.14 mm² per hole at a spinning temperature expressed by the following equation:

$$28.6\,[\eta] + 301.4 \geqq T \geqq 35.7\,[\eta] + 279.3$$

wherein T is the spinning temperature in °C. and $[\eta]$ is the intrinsic viscosity of the polyester, said spinning being at a draft ratio of 50–20,000 and the draft ratio satisfying the following equation:

$$-7.43 \times 10^{-5}W + 2.37 \leqq \log D \leqq 2.27\sqrt{A} + 1.98$$

wherein W is the take-up speed in meters per minute, D is the draft ratio, and A is the cross-sectional area in square millimeter per hole of the spinning nozzle, and then cooling the extruded filaments, and taking up the extruded filaments by Godet rollers at a speed of 3,000 to 8,000 meters per minute.

2. The process of claim 1 wherein the spinning temperature is defined by the following equations $$28.6\,[\eta] + 301.4 \geqq T \geqq 35.7\,[\eta] + 279.3$$

$$T \geqq (73.8\,[\eta] - 88.6)\sqrt{A} + 331.6$$

wherein T is the spinning temperature in °C., $[\eta]$ is the intrinsic viscosity of the polyester, and A is the cross sectional area in square millimeter per hole of the spinning nozzle.

* * * * *

UNITED STATES PATENT AND TRADEMARK OFFICE

CERTIFICATE OF CORRECTION

PATENT NO. : 4,000,239

DATED : December 28, 1976

INVENTOR(S) : Isao Hamana et al.

It is certified that error appears in the above-identified patent and that said Letters Patent are hereby corrected as shown below:

Claim 1, line 3, delete "θ" and insert -- 2θ --

Claim 1, line 4, delete "θ" and insert -- 2θ --

Signed and Sealed this

Tenth Day of May 1977

[SEAL]

*Attest:*

RUTH C. MASON
*Attesting Officer*

C. MARSHALL DANN
*Commissioner of Patents and Trademarks*